United States Patent [19]

Hill

[11] 4,128,196

[45] Dec. 5, 1978

[54] DEVICE FOR CARRYING HANGING CLOTHES

[76] Inventor: Edward J. Hill, 1515 David Whitney Bldg., Detroit, Mich. 48226

[21] Appl. No.: 831,490

[22] Filed: Sep. 8, 1977

[51] Int. Cl.[2] ..... A45C 13/26

[52] U.S. Cl. ..... 224/45 T; 224/45 R

[58] Field of Search ..... 224/29 C, 42.45 A, 42.46 R, 224/42.46 A, 42.46 B, 45 R, 45 T, 45 N, 4 NP, 45 Q, 45 S, 5 P; 108/43, 46; 294/15, 26; 223/88

[56] References Cited

U.S. PATENT DOCUMENTS

| | | | |
|---|---|---|---|
| 3,407,979 | 10/1968 | Patch | 223/88 |
| 3,549,065 | 12/1970 | Schubert | 224/45 T |
| 3,708,093 | 1/1973 | Toms | 224/42.46 A X |
| 3,848,787 | 11/1974 | Hill | 224/45 T |

*Primary Examiner*—Trygve M. Blix
*Assistant Examiner*—Winston H. Douglas
*Attorney, Agent, or Firm*—Arnold, White & Durkee

[57] ABSTRACT

An improved device is disclosed for enabling the user to comfortably carry several clothing garments on hangers. The device is generally boomerang shaped, including two opposed, elongated portions and a curved portion for placement over one's shoulder. One of the elongated portions is adapted to extend behind the shoulders and includes several indentations along its top surface to receive clothes hanger hooks, while the other elongated portion is adapted to be hand held in front of the body. The clothes carrying device is integral, is made in one-piece of plastic material and has an I-shaped cross section for flexural strength.

7 Claims, 5 Drawing Figures

DEVICE FOR CARRYING HANGING CLOTHES

BACKGROUND OF THE INVENTION

1. Field of the Invention

The present invention relates to a plastic member which may be placed on one's shoulder to facilitate carrying hanging clothes, or the like.

2. The Prior Art

Hand carrying clothes or other garments on conventional clothes hangers usually results in severe discomfort to one's fingers, particularly if the clothes are heavy or if the clothes must be carried for substantial distance, such as through an airport. Even if the clothes are carried for a short distance, such as from a dry cleaners to one's car, the clothes hanger hooks tend to "cut" into one's fingers and establish an undesirable discomfort. Additionally, the carrying of hanging clothes usually requires placing the clothes behind one's back and bending the wrist to an uncomfortable position.

To overcome these annoyances, Applicant previously developed the clothes carrying device disclosed in U.S. Pat. No. 3,848,787. That prior device has provided several advances in the art, but inherently includes several disadvantages which are overcome by the present invention. For example, that prior device was relatively expensive, was somewhat bulky, and required assembly for use.

Accordingly, the primary objects of the present invention are to achieve the overall advantages provided by the device of U.S. Pat. No. 3,848,787, yet to improve on that device with further advantageous features.

SUMMARY OF THE INVENTION

The present invention achieves those objects in a single-piece plastic member which includes a curved portion integrally interconnecting a pair of opposed, generally straight portions intersecting in an obtuse angle, preferably of about 140°. The curved portion is shaped for resting on someone's shoulder during use while one of the generally straight portions will extend behind the user's back and the other straight portion will extend forwardly for hand gripping. The rearwardly extending straight portion includes a plurality of notches along its upper surface, as oriented for use, to receive the hooks on conventional clothes hangers.

In the disclosed, preferred embodiment, the clothes carrying device has an I-shaped cross section essentially along its entire length to provide flexural rigidity. Having this cross sectional configuration, the device includes a generally vertical, central web and top and lower transverse webs which are generally perpendicular to and integral with the central web. The top transverse web borders the notches along the top surface of the rearwardly extending portion to provide greater flexural strength. Additionally, a reinforcing rib is provided on each side of the central web between the top and lower webs at the bottom of each notch.

Accordingly, the present invention provides numerous advantages. First, the clothes carrying device places the weight of hanging clothes on one's shoulder rather than on the hands or the fingers of someone required to carry clothes on hangers. Second, the device of the present invention is inexpensive and therefore capable of being disposed of after use. Third, the device, because of its construction, is susceptible to mass production, such as by injection molding. Fourth, the construction is durable, lightweight, and may be easily packed in a suitcase or briefcase when not in use. Fifth, the device is of a one-piece construction and is therefore ready for use without assembly. Sixth, the most preferred construction includes an I-beam cross section to provide flexural rigidity along the length of the device, even in the notched areas where the hooks of hangers will be placed.

These and other numerous advantages and meritorious features will be more fully appreciated from the following detailed description and the appended claims.

DETAILED DESCRIPTION OF THE PREFERRED EMBODIMENT

Figure 1:
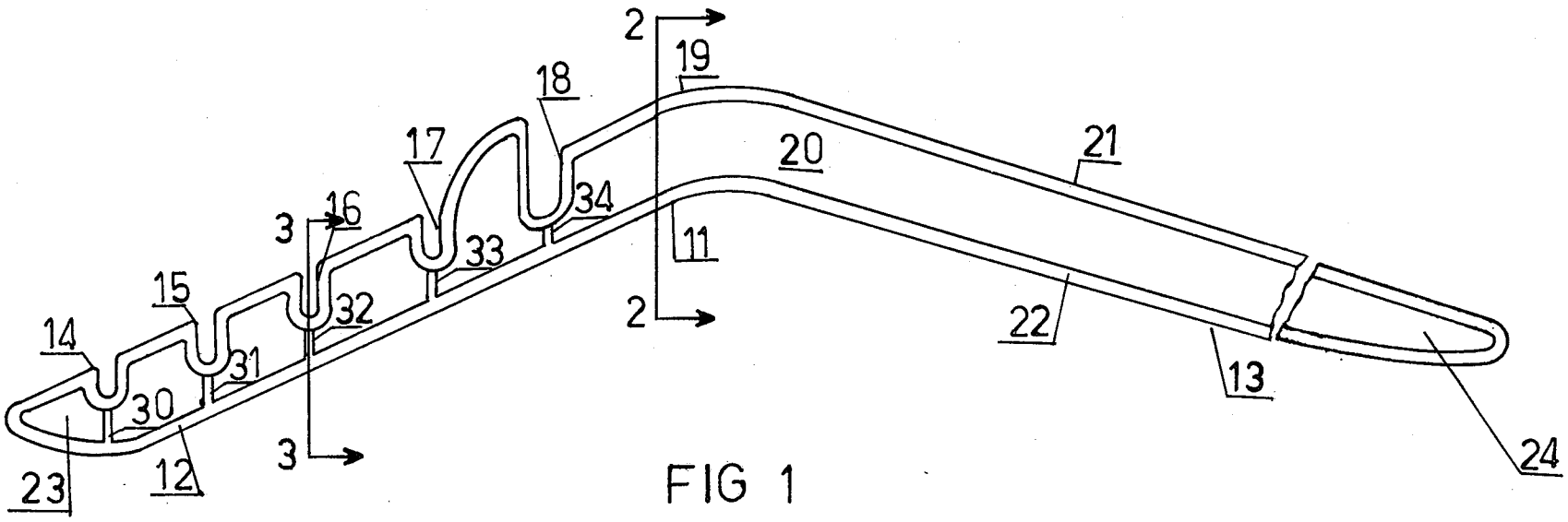
FIG. 1 is a side elevation of the clothes carrying device of the present invention, illustrating the clothes carrier generally in the position as it would be placed on someone's shoulder.

The hanging clothes carrier 10 of the present invention is shown in side elevation in FIG. 1 generally in the position that the device will assume in use on one's shoulder. As shown, the carrier 10 is generally boomerang-shaped, including a curved portion 11 integrally interconnecting opposed, generally straight portions 12 and 13. In use, curved portion 11 will be placed on the shoulder; portion 13 will extend forwardly from the shoulder and will be gripped by the user's hand to counterbalance the weight of clothes suspended from clothes hangers having hooks positioned on indentations or notches 14, 15, 16, and 17 on the top surface of portion 12. A larger notch 18 is provided to receive a group of clothes hanger hooks or a handle such as on a flight bag. Preferably the larger notch 18 is positioned as near as possible to the crest 19 of the device in order to place the heavier loads nearer the point of support in order to minimize the bending moments. As will be appreciated, the clothes carrier of the present invention will be positioned in use somewhat similarly to the clothes carrier device of U.S. Pat. No. 3,848,787 (incorporated by reference).

Figure 2:
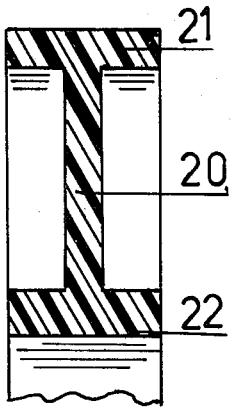
FIG. 2 is a cross sectional view taken along plane 2—2, as shown in FIG. 1, illustrating the I-beam cross sectional construction.

In the disclosed, preferred embodiment, the clothes carrier 10 has an I-beam cross-sectional configuration along essentially its entire length, as shown in FIG. 2, to provide flexural rigidity, yet to minimize the material required in its construction. With this configuration, the carrier device 10 includes a central, generally vertical web 20, as oriented for use, and top and lower transverse webs 21 and 22, respectively, which are generally perpendicular to the central web. As shown, the central web 20 tapers at its ends in regions 23 and 24, such that the top and lower webs converge.

Figure 3:
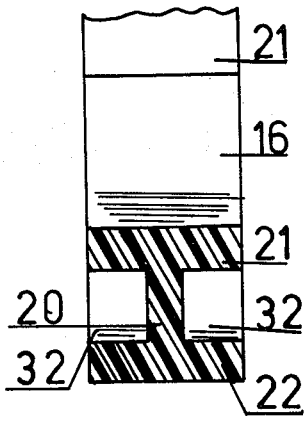
FIG. 3 is a cross sectional view taken along plane 3—3, as shown in FIG. 1, illustrating the cross section of the device in the region of one of the hanger indentations.

In order to achieve greater flexural strength, the top transverse web 21 preferably extends down into and around the periphery of notches 14–18. Additionally, reinforcing ribs 30, 31, 32, 33 and 34 are provided to respectively extend from between the top and lower transverse webs 21 and 22 at the bottoms of recesses 30, 31, 32, 33 and 34. This construction is best illustrated collectively in FIGS. 1 and 3, FIG. 3 illustrating that the ribs are provided on each side of central vertical web 20.

As will be appreciated, the various portions of the present device may be dimensioned as desired. Proposed dimensions, however, are as follows: Section 13 is about 11 inches long while section 12 is about 7½ inches long, as measured from crest 19; webs 20, 21, and 22 are ⅛ inch thick, the latter two being about 9/16 inch wide along the dimension shown in FIG. 2; reinforcing ribs 30–34 are about one-sixteenth inch thick; notches 14–17 are about 3/32 inch wide as measured along the length of portion 12, whereas notch 18 is about ⅝ inch wide; and elongated portions 12 and 13 intersect at an included angle of about 140°.

Preferably, the device should be constructed as a one-piece unitary member to provide a simple construction. This may be achieved, for example, by injection molding using a plastic material such as ABS.

Of course, various modifications may be made to the disclosure without departing from the overall invention as expressed in the following claims. For example, the indentations may be modified in size and position, the angle between the elongated portions may be modified and various materials may be employed.

Having therefore completely and sufficiently disclosed my invention, I now claim:

1. A device for carrying hanging clothes, comprising:

a central web of plastic material including a curved portion integrally interconnecting first and second generally straight portions, the curved portion being adapted for placement over one's shoulder when using the clothes carrying device such that the first and second portions extend downwardly from the horizontal at acute angles, the first portion being adapted to extend rearwardly from one's shoulder and having a plurality of recesses along its top surface for receiving the hooks of clothes hangers, or the like, the second portion being adapted to extend forwardly from one's shoulder and to be hand-gripped;

a first transverse web of plastic material integral with and generally perpendicular to said central web and extending along the top surface of said first, second, and curved portions and along the peripheriphy of said recesses for reinforcement;

a second transverse web of plastic material generally perpendicular to and integral with said central web and extending along the bottom surface of said first, second and curved portions for reinforcement; said second transverse web extending to each side of the central web and being substantially wider than the thickness of the central web to provide rigidity and to provide a surface for distributing the load on one's shoulder when in use;

said transverse webs extending along substantially the entire lengths of said first, second, and curved sections; and reinforcing ribs extending between the first and second transverse webs at the bottom of each said recess, said ribs being on each side of and generally perpendicular to said central web.

2. The clothes carrying device as defined in claim 1, wherein said first transverse web extends to each side of the central web, providing a general I-shaped cross-sectional configuration.

3. The clothes carrying device as defined in claim 1, wherein the ends of said first and second portions of the central web taper and wherein the first and second transverse webs merge at the tapered ends of said central web.

4. The clothes carrying device as defined in claim 1, wherein at least one of said recesses is larger than the other recesses to accommodate the receipt of larger hooks or straps, such as on flight bags.

5. The clothes hanging device as defined in claim 1, wherein the width of said first and second transverse webs is about four and a half times the thickness of the central web.

6. The clothes hanging device as defined in claim 5, wherein said transverse webs are about 9/16 inch wide and the central web is about ⅛ inch thick.

7. The clothes hanging device as defined in claim 5, wherein the first and second generally straight sections form an included angle of about 140°.

* * * * *